US008590491B2

(12) United States Patent
Castelain

(10) Patent No.: US 8,590,491 B2
(45) Date of Patent: Nov. 26, 2013

(54) DEVICE FOR PRODUCING HEAT BY CIRCULATING A FLUID UNDER PRESSURE THROUGH A PLURALITY OF TUBES, AND A THERMODYNAMIC SYSTEM IMPLEMENTING SUCH A DEVICE

(75) Inventor: Gilles Jacques Castelain, Saint Cyr la Rosiere (FR)

(73) Assignee: IB.NTEC, Berd Huis (FR)

( * ) Notice: Subject to any disclaimer, the term of this patent is extended or adjusted under 35 U.S.C. 154(b) by 997 days.

(21) Appl. No.: 12/667,508

(22) PCT Filed: Jul. 5, 2007

(86) PCT No.: PCT/FR2007/001141

§ 371 (c)(1),
(2), (4) Date: Dec. 31, 2009

(87) PCT Pub. No.: WO2009/004124

PCT Pub. Date: Jan. 8, 2009

(65) Prior Publication Data

US 2010/0190124 A1 Jul. 29, 2010

(51) Int. Cl.
*F28D 7/16* (2006.01)

(52) U.S. Cl.
USPC ..... 122/235.29; 122/406.3

(58) Field of Classification Search
USPC ..... 122/367.1, 406.3, 451.2, 235.29, 31.1; 137/601.18; 138/40
See application file for complete search history.

(56) References Cited

U.S. PATENT DOCUMENTS

| | | | | |
|---|---|---|---|---|
| 1,912,670 | A * | 6/1933 | Trumble et al. | 96/201 |
| 4,244,423 | A * | 1/1981 | Thut et al. | 165/82 |
| 4,602,682 | A * | 7/1986 | Yamamoto et al. | 165/174 |
| 4,607,689 | A * | 8/1986 | Mochida et al. | 165/110 |
| 4,842,055 | A * | 6/1989 | Ohtsu | 165/174 |
| 5,031,692 | A * | 7/1991 | Kehrer et al. | 165/134.1 |
| 5,055,030 | A * | 10/1991 | Schirmer | 431/10 |
| 5,630,470 | A * | 5/1997 | Lockwood, Jr. | 165/82 |
| 5,852,990 | A * | 12/1998 | Primdahl | 122/7 R |
| 6,032,616 | A * | 3/2000 | Jones | 122/32 |
| 6,076,518 | A * | 6/2000 | Klouda et al. | 126/391.1 |
| 6,948,453 | B1 * | 9/2005 | DeAngelo et al. | 122/32 |
| 7,784,433 | B2 * | 8/2010 | Birk | 122/31.1 |
| 8,240,368 | B2 * | 8/2012 | Graham | 165/178 |
| 2005/0040023 | A1 * | 2/2005 | Hino et al. | 202/82 |

FOREIGN PATENT DOCUMENTS

| | | | |
|---|---|---|---|
| DE | 829 173 | C | 1/1952 |
| DE | 975 508 | C | 12/1961 |
| DE | 195 00 421 | A1 | 11/1995 |
| EP | 0 044 349 | A | 1/1982 |
| FR | 2 850 738 | A | 8/2004 |
| FR | 2 898 965 | A | 9/2007 |

* cited by examiner

*Primary Examiner* — Gregory A Wilson
(74) *Attorney, Agent, or Firm* — Sughrue Mion, PLLC

(57) ABSTRACT

The present invention provides a secondary heat production device (5) for fitting to a closed circuit thermodynamic system associating main heat production means (1) operating by compressing a fluid and a heat exchanger (2) that are interconnected by a fluid flow channel (3). The device (5) is mainly constituted by a plurality of individual channels (8, 9) interposed between an inlet chamber (11) and an outlet chamber (13), each of the chambers (11, 13) including a respective inlet or outlet pipe (10, 12) on a common axis and presenting respective identical main sections corresponding to the total section of the individual channels (8, 9).

20 Claims, 2 Drawing Sheets

DEVICE FOR PRODUCING HEAT BY CIRCULATING A FLUID UNDER PRESSURE THROUGH A PLURALITY OF TUBES, AND A THERMODYNAMIC SYSTEM IMPLEMENTING SUCH A DEVICE

CROSS REFERENCE TO RELATED APPLICATIONS

This is a National Stage of International Application No. PCT/FR2007/001141 filed Jul. 5, 2007, the contents of all of which are incorporated herein by reference in its entirety.

TECHNICAL FIELD OF THE INVENTION

The present invention relates to the field of thermodynamics, and more particularly to the field of appliances for producing heat by making use of a fluid under pressure. The invention provides a device for producing heat from a flow of a fluid under pressure passing therethrough.

STATE OF THE ART

In the field of thermodynamics, systems are known that associate means for producing heat by compressing a first fluid, in particular a gas, said means using a compressor, and means for making use of the heat that is produced by implementing a heat exchanger for exchanging heat between the first fluid maintained under pressure and a second fluid. Such systems comprise more particularly the compressor for putting the first fluid under high pressure, such as about 30 bars, for example, a flow channel for conveying the compressed first fluid between the compressor and the heat exchanger, and said heat exchanger. The system is particularly organized as a closed circuit within which the first fluid circulates under pressure, said closed circuit comprising the compressor and the heat exchanger which are interconnected by said channel. It will be understood that the channel comprises a delivery pipe interposed in the fluid flow direction between the compressor and the heat exchanger, and a return pipe interposed, still in the fluid flow direction, between the heat exchanger and the compressor. In general, the temperature of the first fluid at the outlet from the compressor depends on its nature and on the pressure to which it is subjected. Such systems are suitable for placing downstream from a refrigerating unit, in particular a unit implementing a heat pump, or downstream from a geothermal unit, for example.

OBJECT OF THE INVENTION

The object of the present invention is to propose a device for fitting to a thermodynamic system that associates main means for producing heat by compressing a fluid and a heat exchanger that are interconnected by a fluid flow channel. The device of the present invention is in particular a device for secondary heat production serving to increase the temperature of the compressed fluid downstream from the heat exchanger in the fluid flow direction through the system. More particularly, the device of the present invention seeks to increase the heat given off by the first fluid at the outlet from the compressor and downstream from the heat exchanger, but without significantly changing the reference pressure of the fluid within the major fraction of the system, said reference pressure corresponding to the pressure obtained under the effect of the compressor.

The inventive step of the present invention consists overall in organizing at least part of the channel conveying the compressed fluid between the compressor and the heat exchanger in the fluid flow direction as a plurality of individual channels. To avoid significantly modifying the reference pressure and/or flow rate of the fluid conveyed through the system, firstly the main sections of the outlet channel from the compressor and of the inlet channel to the heat exchanger are identical, and secondly the total section of the individual channels is of the order of as close as possible to said main section.

It has been found, surprisingly, that such an organization for the flow channel gives rise to a non-negligible increase in the heat of the fluid compared at the inlets and the outlets of the secondary channels. Depending on the nature and the pressure of the fluid within the system, this increase as observed by measurements may be as much as 50% of the initial temperature of the fluid at the outlet from the compressor. By way of example, for the fluid being Freon maintained at a pressure of the order of 30 bars, the temperature of the fluid at the inlet to the individual channels is about 100° C., while the temperature of the fluid at the outlet from the individual channels is about 150° C.

This gives rise to an additional difficulty to be overcome that lies in maintaining the pressure of the fluid at the reference pressure, in spite of the geometrical structural organization of the transformation of the channel from one tube of the main section and a plurality of tubes of the section with individual tubes, and vice versa. More particularly, it is necessary to avoid the consequences of any potential modification of the pressure of the fluid as a result of passing through the secondary channels relative to the reference pressure for the fluid flowing in the remainder of the system. Such a change of pressure would be likely to result in the formation of a constriction and/or an expansion chamber in the transition zones of the channel where it passes between its main section and its individual sections, and vice versa. For this purpose, the present invention proposes, in secondary manner, to organize the geometrical structure of these transition zones so as to avoid the consequences of any such modification to the pressure of the fluid.

Firstly, the transition zone at the inlet to the individual channels passing from an inlet pipe of the main section connected to the main channel and leading to the plurality of individual sections is organized as an inlet chamber. This inlet chamber provides firstly a progressive increase in the main section of the inlet pipe, in particular on the basis of a flare of its outlet facing the individual channels, and secondly an opposite inclination of the inlets to the individual channels facing the outlet from the inlet pipe. Preferably, the slope of the opposite inclination is considered generally for all of the corresponding inlets of the juxtaposed individual channels. Nevertheless, and in another variant embodiment, the inclinations of the inlet to the individual channels are individualized, with each of the individual channels nevertheless having a slope opposite to the flare of the corresponding outlet from the inlet pipe. The juxtaposition of individual channels is made up in particular of a juxtaposition of peripheral individual channels that are radially offset around the axis of the inlet pipe. This juxtaposition of peripheral individual channels is preferably associated with the addition of a middle individual channel lying on the axis of the inlet pipe. Under such circumstances, and more particularly, the flare at the outlet from the inlet pipe lies in the range about 45° to 75°, and is arranged generally facing all of the inlets of the peripheral individual channels, and also the middle individual channel, if any. The slope of the inverse inclination of the peripheral individual channels, preferably considered generally as an overall angle relative to the axis of the inlet pipe, lies in the range about 90° to 160°. Values that have been found to be suitable are 60° for the flare at the outlet from the inlet pipe, and 120° for the angle corresponding to the slope of the inverse inclination of the peripheral individual channels.

Secondly, the transition zone of the outlets from the individual channels leading towards an outlet pipe having the main section is organized as an outlet chamber that is generally arranged as a Venturi effect device. More particularly, the outlets from the peripheral individual channels facing the inlet of the outlet pipe have inclinations with a slope that is oriented in a direction analogous to the slope of a flare included in the inlet of the outlet pipe. Preferably, the slope of the inclination of the outlets of the peripheral individual channels is considered generally for all of the outlets of the peripheral individual channels. Nevertheless, in another variant embodiment, the inclinations of the outlets of the peripheral individual channels are individualized, with each of the individual channels nevertheless having a slope oriented in a direction analogous to the slope of the flare of the corresponding inlet to the outlet pipe. More particularly, the flare at the inlet to the outlet pipe lies in the range about 30° to 50°, and is arranged generally facing all of the outlets of the peripheral individual channels, and also the outlet of the middle individual channel, if any. The slope of the angle of inclination of the peripheral individual channels, preferably considered generally as a general angle relative to the axis of the outlet pipe lies in the range about 180° to 270°. Values that have been found appropriate are 40° for the flare of the inlet to the outlet pipe, and 240° for the angle corresponding to the slope of the inclination of the peripheral individual channels.

In general terms, the device of the present invention is a secondary heat production device for fitting to a closed circuit thermodynamic system associating main heat production means operating by compressing a fluid and a heat exchanger. The heat production means and the heat exchanger are in particular interconnected by a flow channel for the fluid under pressure.

According to the present invention, such a device is recognizable in that it is mainly constituted by a plurality of individual channels interposed between an inlet chamber and an outlet chamber. Each of these chambers has a respective inlet or outlet pipe, which pipes lie on a common axis, each of them having an identical respective main section that corresponds to the total section of the individual channels.

The individual channels are preferably disposed side by side leaving gaps between them. These individual channels comprise in particular peripheral individual channels that are radially offset around the common axis of the inlet and outlet pipes, possibly together with a middle individual channel lying on the same axis as the inlet and outlet pipes.

More particularly, the inlet chamber forms a flare at the outlet from the inlet pipe generally facing the individual channels. In addition, the inlet chamber forms more particularly an inclination for the inlets to the peripheral individual channels facing the inlet pipe and having a slope of orientation that is opposite to the slope of the flare at the outlet from the inlet pipe. As mentioned above, the inclinations of the inlets to the individual channels may either be individualized for each of the individual channels, in particular with respective slopes depending on individual positions relative to the axis of the inlet pipe, or else generalized over all of the inlets of the peripheral individual channels. Under such circumstances, and for example, the inlet chamber forms a second flare into which the peripheral individual channels open out, the second flare being of a slope of orientation that is opposite to the slope of the flare at the outlet from the inlet pipe.

Preferably, the outlet chamber is generally organized as a Venturi effect device. More particularly, the outlet chamber forms a flare at the inlet to the outlet pipe generally facing the individual channels. Furthermore, the outlet chamber forms more particularly an angle of inclination for the outlets of the peripheral individual channels facing the outlet pipe with a slope of orientation analogous to the orientation of the slope of the flare at the inlet to the outlet pipe. As mentioned above, the angles of inclination of the outlets of the individual channels may either be individualized for each of the individual channels, in particular with respective slopes depending on their positions relative to the axis of the outlet pipe, or else they may be generalized for all of the outlets of the peripheral individual channels. Under such circumstances, and for example, the outlet chamber forms a second flare into which the peripheral individual channels open out, the second flare being of slope with an orientation that is analogous to the slope of the flare at the inlet to the outlet pipe.

The device may equally well be a single piece and/or made up of elements that are assembled together in separable manner. Such elements may be assembled together by screw fastening or by means of fitted and/or incorporated assembly members. When the elements are connected together as a single unit, such connection may be achieved by adhesive, by welding, or by some other analogous technique.

In an embodiment of the invention, the device has two bodies, respectively an inlet body and an outlet body. The inlet pipe extended by the inlet chamber is formed within the inlet body. The outlet pipe extended by the outlet chamber is formed within the outlet body. Such internal arrangements of the bodies can be made by machining or by molding, for example, or by using analogous techniques. The bodies are connected together by the individual channels. These channels are advantageously constituted by ducts made by material-drawing or analogous techniques. The material constituting the ducts at least, and possibly also the bodies, is a metal having a high thermal coefficient, such as copper and/or brass. The bodies are provided with assembly means for assembling them to the respective junctions of a flow channel for a fluid under pressure. These assembly means may equally well be releasable assembly means using screw fastening or analogous techniques, and/or permanent assembly means such as using adhesive, welding, or analogous techniques. Preferably, the assembly means include thermally insulating junction members for interposing between the bodies and the corresponding junctions of the flow channel.

Preferably, the individual channels as a unit are surrounded by a thermally insulating sheath, that advantageously constitutes an obstacle to heat being radiated from the individual channels, firstly so as to make the device safe relative to the outside, and secondly so as to avoid unwanted loss of heat and so as to encourage heat exchange between the individual channels and the fluid.

The invention also provides a closed circuit thermodynamic system associating main heat production means operating by compressing a fluid and a heat exchanger that are interconnected by a flow channel for fluid under pressure. According to the present invention, such a thermodynamic system is mainly recognizable in that it includes at least one secondary heat production device as described above. More particularly, the device is placed in the flow channel, being interposed in the fluid flow direction between the main heat production means and the heat exchanger.

DESCRIPTION OF THE FIGURES

The present invention can be better understood and details thereof appear from the following description of a preferred embodiment given with reference to the figures of the accompanying sheets, in which:

In FIG. 1, a thermodynamic system mainly associates main heat production means 1 and a heat exchanger 2. A main closed circuit conveys a first heat transfer fluid, such as Freon or an analogous fluid, between the main heat production means 1 and the heat exchanger 2, which are interconnected by a first fluid flow channel 3. The first fluid flows through the heat exchanger 2 to heat a second fluid, for use in a heating installation, for example. The heat production means 1 make use of a compressor 4 or an analogous appliance, in particular of the heat pump type, to compress the first fluid to high pressure, such as of the order of 30 bars.

In order to increase the production of first fluid heat, a device 5 of the invention is placed on the flow channel 3 between the compressor 4 and the heat exchanger 2 in the fluid flow direction. The device 5 is a secondary heat production device for increasing the heat of the first fluid as it passes therethrough.

Figure 1:
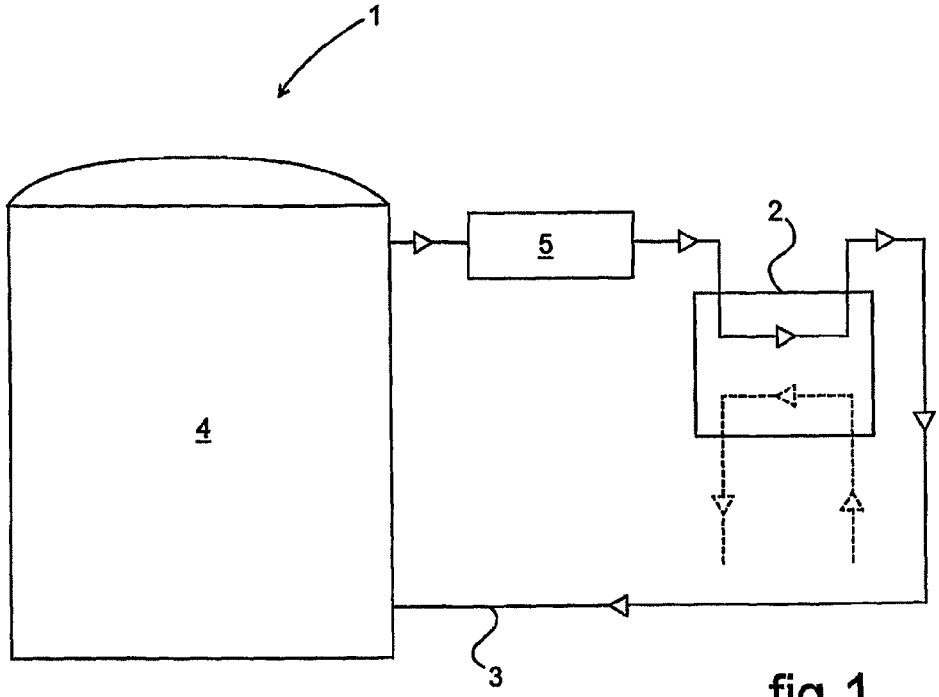
FIG. 1 is a diagram of a thermodynamic system fitted with a device of the present invention.
Figure 2:
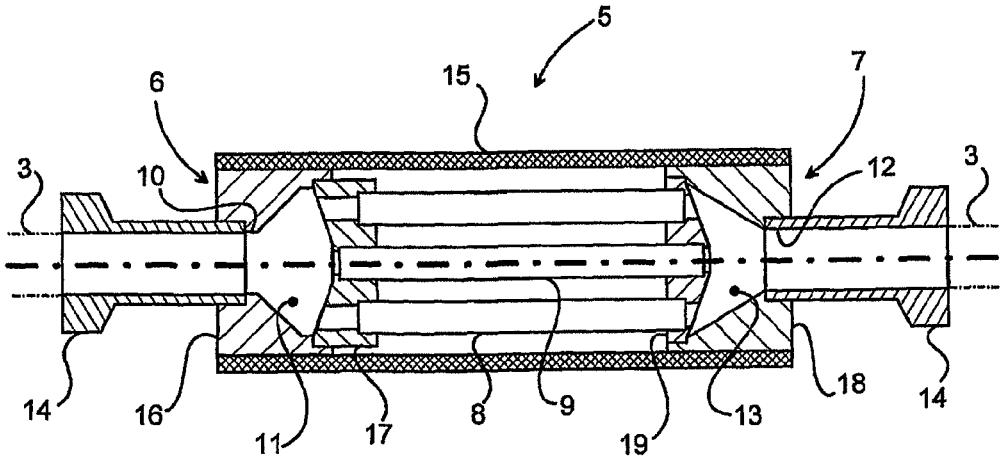
FIG. 2 is a diagram in axial section showing a device of the present invention in a preferred embodiment.

In FIG. 2, the device 5 of the invention mainly comprises two bodies 6 and 7 for connection to respective junctions of the flow channel 3. These bodies, respectively an inlet body 6 and an outlet body 7 relative to the fluid flow direction are interconnected by individual channels 8 and 9 presenting a total section of the same order as the main section of the flow channel 3. Inside these bodies 6 and 7 there are provided respectively: for the inlet body 6, an inlet pipe 10 and an inlet chamber 11; and for the outlet body 7, an outlet pipe 12 and an outlet chamber 13. The inlet and outlet pipes 10 and 12 are on the same axis, and present respective sections of the same order as the same section of the flow channel 3. The inlet and outlet bodies 6 and 7 are provided with respective assembly means for assembling with the corresponding junctions of the flow channel 3, and in particular including thermally insulating junction members 14. These junction members 14 are constituted by intermediate rings of thermally insulating material, such as Bakelite or an analogous material. Preferably, these assembly means are releasable assembly means so as to enable the device 5 to be installed in a pre-existing thermodynamic system.

There are several individual channels 8 and 9. Peripheral individual channels 8 are radially distributed around the general axis A of the inlet and outlet pipes 6 and 7. The number of these peripheral individual channels 8 is selected as a compromise between the main section of the flow channel 3 that is to be subdivided into a plurality of individual sections relating to the individual channels 8 and 9, the overall size of the device 5, and its effectiveness. It has been found that such a compromise leads to the number of peripheral individual channels 8 lying in the range 3 to 12, with said number ideally being about 8. Preferably, the individual channels include a middle individual channel 9 lying on the same axis as the inlet and outlet pipes 10 and 12.

A thermally insulating sheath 15 surrounds at least the individual channels 8 and 9, being engaged on the inlet and outlet bodies 6 and 7. Such a sheath 15 may be put into place by threading the sheath 15 over the bodies 6 and 7, and preferably fastening it thereto, either in permanent manner or in releasable manner so as to give the option of obtaining access to the individual channels 8 and 9, and to the inlet and outlet bodies 6 and 7.

Each of the inlet and outlet bodies 6 and 7 is made of up at least two component bodies 16 & 17 and 18 & 19 that are assembled together so as to make it easier to form the inlet and outlet chambers 11 and 13. The components bodies 16 & 17 and 18 & 19 are assembled together by fastener means that may equally well be releasable, e.g. by screw fastening or an analogous technique, and/or permanent such as by adhesive and/or welding or some other analogous techniques.

The individual channels 8, 9 are connected at their respective ends to the inlet and outlet bodies 6 and 7 via connection means, which means may equally well be releasable, e.g. by mutual engagement or some analogous technique, and/or permanent, the above-mentioned engagement possibly being associated with operations involving adhesive and/or welding, or other analogous techniques.

Figure 3:
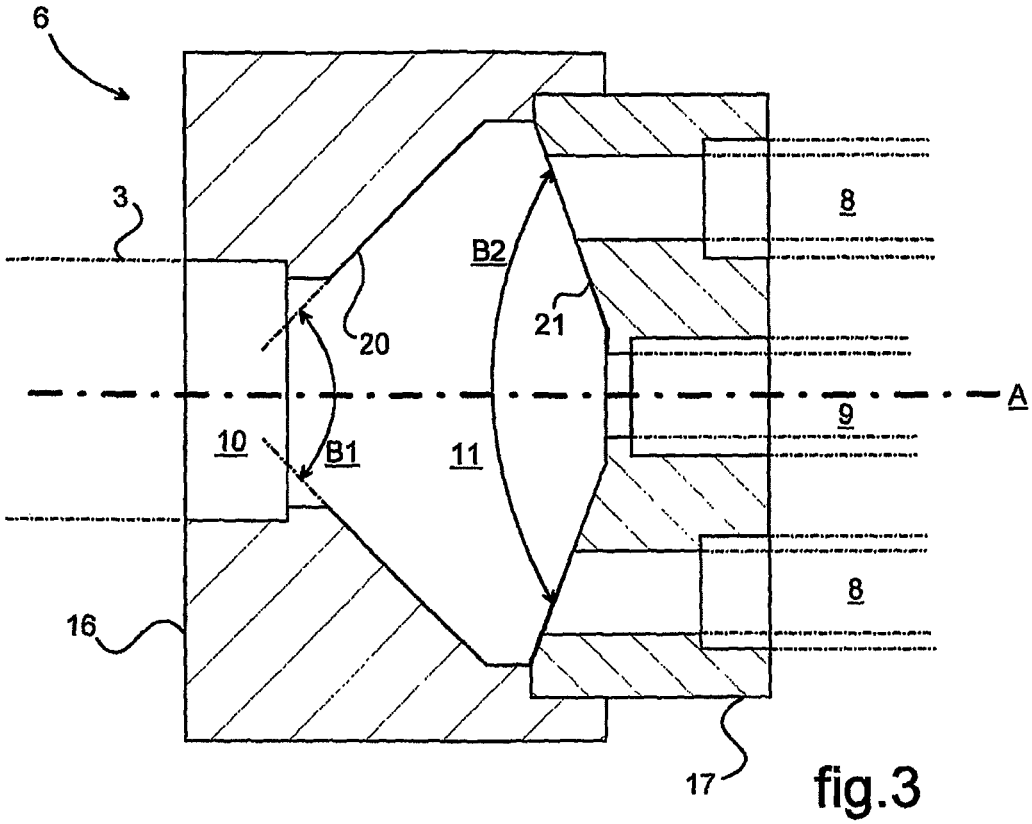
FIG. 3 is a detail showing an inlet chamber included in the device shown in FIG. 2.

In FIG. 3, the inlet chamber 11 is organized to limit hydraulic head losses when the fluid passes from the inlet pipe 10 to the individual channels 8 and 9. Firstly, the outlet from the inlet pipe 10 facing the individual channels 8 and 9 has a first flare 20 of angle B1 equal to about 60°. This first flare 20 is formed in particular in a first component body 16 of the inlet body 6. Secondly, the inlets of the individual channels, and more particularly those of the peripheral individual channels 8 facing the inlet pipe 10 present an inclination 21 of opposite direction to that of the slope of the first flare 20 included in the outlet of the inlet pipe 10. This inclination 21 is based on a second flare in the second component body 17 of the inlet body 6. The first and second flares 20 and 21 of the inlet body 6 lie on the same axis as the axis A common to the inlet and outlet pipes 10 and 12. In this respect, the inclination 21 of the inlets to the peripheral individual channels 8 is to be considered for the inlets considered as a whole. The slope of the inclination 21, corresponding to the slope of the second flare in the inlet body 6 presents an overall angle B2 of about 120° about the axis of the inlet pipe. A suitable ratio for the angle B2 relative to the angle B1 is of the order of double.

Figure 4:
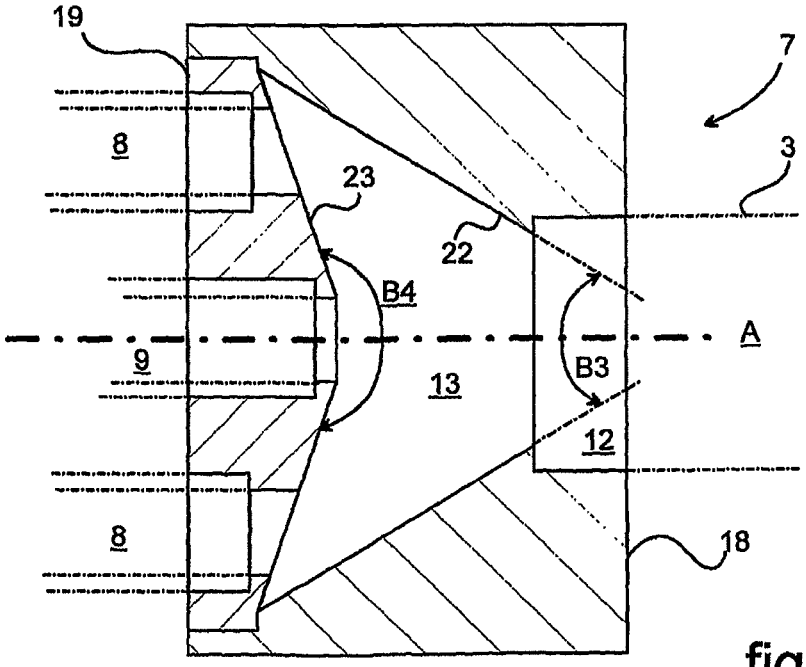
FIG. 4 is a detail showing an outlet chamber included in the device shown in FIG. 2.

In FIG. 4, the outlet chamber 13 is arranged as a Venturi effect device. More particularly, and firstly, the inlet to the outlet pipe 12 facing the individual channels 8 and 9 has a first flare 22 with an angle B3 of about 40°. This first flare 22 is provided in particular inside a first component body 18 of the outlet body 7. Secondly, the outlet from the individual channels, and more particularly the peripheral individual channels 8, facing the outlet pipe 12 present an inclination 23 with the same orientation as the slope of the first flare 20 included in the inlet of the outlet pipe 12. This angle of inclination 23 is arranged on the basis of a second flare included in a second component body 19 of the outlet body 7. The first and second flares 22 and 23 of the outlet body 7 lie on the same axis as the axis A common to the inlet and outlet pipes 10 and 12. In this respect, the inclination 23 of the outlets of the peripheral individual channels 8 needs to be considered as a whole for these outlets. The slope of the inclination 23, corresponding to the slope of the second flare included in the outlet body 7 forms an overall angle B4 of about 240° relative to the axis A of the outlet pipe 12. A suitable ratio for the angle B4 relative to the angle B3 is about six times greater.

The invention claimed is:

1. A closed circuit thermodynamic system associating main heat production means operating by compressing a fluid and a heat exchanger that are interconnected by a flow channel for fluid under pressure, the system comprising at least one secondary heat production device placed in the flow channel, interposed in the fluid flow direction between the main heat production means and the heat exchanger; wherein at least part of said flow channel is formed by a plurality of individual channels, said plurality of individual channels interposed between an inlet chamber and an outlet chamber, each of the chambers having a respective inlet or outlet pipe of identical respective main sections corresponding to the total section of said plurality of individual channels, said plurality of individual channels comprising peripheral individual channels that are radially offset around a common axis shared by the inlet and outlet pipes, which lie on a common axis.

2. The system according to claim 1, wherein the individual channels further comprise a middle individual channel lying on the same axis as the inlet and outlet pipes.

3. The system according to claim 1, wherein the inlet chamber forms a flare at the outlet of the inlet pipe leading generally to the individual channels.

4. The system according to claim 3, wherein the inlet chamber forms an angle of inclination made up of the inlets to the peripheral individual channels facing the inlet pipe with a slope of orientation that is opposite to the slope of the flare at the outlet from the inlet pipe.

5. The system according to claim 1, wherein the outlet chamber is generally organized as a Venturi effect device.

6. The system according to claim 5, wherein the outlet chamber forms a flare constituting the inlet to the outlet pipe facing the individual channels.

7. The system according to claim 6, wherein the outlet chamber forms an angle of inclination made up of the outlets from the peripheral individual channels facing the outlet pipe with a slope of orientation analogous to the orientation of the slope of the flare at the inlet of the outlet pipe.

8. The system according to claim 1, wherein the secondary heat production device is a one-piece integral construction.

9. The system according to claim 1, wherein the secondary heat production device comprises two bodies, respectively an inlet body and an outlet body, having arranged respectively therein, for the inlet body the inlet pipe extended by the chamber, and for the outlet body the outlet pipe extended by the outlet chamber, these bodies being interconnected by the individual channels and being provided with assembly means for assembling with respective junctions of said flow channel for a fluid under pressure.

10. The system according to claim 9, wherein the assembly means is releasable, comprising thermally insulating junction members for interposing between the bodies and the corresponding junctions of the flow channel.

11. The system according to claim 9, wherein the assembly means is permanent, comprising thermally insulating junction members for interposing between the bodies and the corresponding junctions of the flow channel.

12. The system according to claim 1, wherein the secondary heat production device is formed by a plurality of elements assembled to one another.

13. A closed circuit thermodynamic system, comprising:

a main heat production unit that compresses a fluid;

a heat exchanger in fluid communication via a flow channel with the main heat production unit;

a secondary heat production device placed in the flow channel, interposed between the main heat production unit and the heat exchanger, the secondary heat production device comprising an inlet chamber and an outlet chamber and a plurality of individual channels interposed between the inlet chamber and the outlet chamber; the inlet chamber having an inlet pipe and the outlet chamber having an outlet pipe, the inlet pipe and the outlet pipe having respective main flow sections substantially corresponding to a total flow section of the plurality of individual channels, the plurality of individual channels comprising individual channels that are radially offset around an axis passing through centers of the inlet pipe and the outlet pipe.

14. The system according to claim 13, wherein the plurality of individual channels further comprise a middle individual channel lying on the axis passing through the centers of the inlet pipe and the outlet pipe.

15. The system according to claim 13, wherein the inlet chamber forms a flare at an outlet of the inlet pipe leading generally to the plurality of individual channels.

16. The system according to claim 15, wherein the inlet chamber forms an angle of inclination made up of inlets to the plurality of individual channels facing the inlet pipe with a slope of orientation that is opposite to the slope of the flare at an outlet from the inlet pipe.

17. The system according to claim 13, wherein the outlet chamber is configured as a Venturi effect device.

18. The system according to claim 17, wherein the outlet chamber forms a flare constituting an inlet to the outlet pipe facing the plurality of individual channels.

19. The system according to claim 18, wherein the outlet chamber forms an angle of inclination made up of outlets from the plurality of individual channels facing the outlet pipe with a slope of orientation analogous to an orientation of a slope of a flare at the inlet of the outlet pipe.

20. The system according to claim 13, wherein the secondary heat production device comprises two bodies, respectively an inlet body and an outlet body, having arranged respectively therein, for the inlet body the inlet pipe extended by the inlet chamber, and for the outlet body the outlet pipe extended by the outlet chamber, the two bodies interconnected by the plurality of individual channels and coupled to respective junctions of the flow channel.

* * * * *